United States Patent [19]

Wright

[11] 4,384,650

[45] May 24, 1983

[54] SPIRAL SEPARATOR

[75] Inventor: Douglas C. Wright, Terranora, Australia

[73] Assignee: Inheed Pty. Ltd., New South Wales, Australia

[21] Appl. No.: 250,414

[22] Filed: Apr. 2, 1981

[30] Foreign Application Priority Data

Apr. 30, 1980 [AU] Australia ..... PE3345

[51] Int. Cl.[3] ..... B07C 9/00

[52] U.S. Cl. ..... 209/697; 209/211

[58] Field of Search ..... 209/696, 697, 211; 210/787, 512.1

[56] References Cited

U.S. PATENT DOCUMENTS

| | | | |
|---|---|---|---|
| 629,591 | 7/1899 | Pardee | 209/697 |
| 840,354 | 1/1907 | Lyle | 209/697 X |
| 1,698,101 | 1/1929 | Martling | 209/211 |
| 1,863,027 | 6/1932 | Pardee | 209/696 X |
| 1,880,185 | 9/1932 | Kerns et al. | 210/512.1 |
| 2,145,315 | 1/1939 | Pardee | 209/697 |
| 2,425,110 | 8/1947 | McCurdy | 210/512.1 |
| 2,431,559 | 11/1947 | Humphreys | 209/211 |
| 3,910,835 | 10/1975 | Stafford | 209/697 |

*Primary Examiner*—Allen N. Knowles

*Attorney, Agent, or Firm*—Maky, Renner, Otto & Boisselle

[57] ABSTRACT

A spiral separator includes an upright column supported with its axis substantially vertical and adapted to receive at an upper end thereof a pulp of water and particles to be separated. The spiral separator also includes a plurality of helical turns mounted to said upright column wherein at least in a top portion of the separator there is provided a channel located on an outer part of the separator. The channel is initially narrow and deep and becomes progressively wider to enable the particles to obtain or maintain an initial velocity so as to maintain the flow of pulp without the coarser and/or less dense particles becoming stationary or stranding and wherein the coarser and/or less dense particles may be retained in an outer section of the channel and the finer and/or denser particles may move toward an inner section of the channel and be retained in said inner section.

21 Claims, 8 Drawing Figures

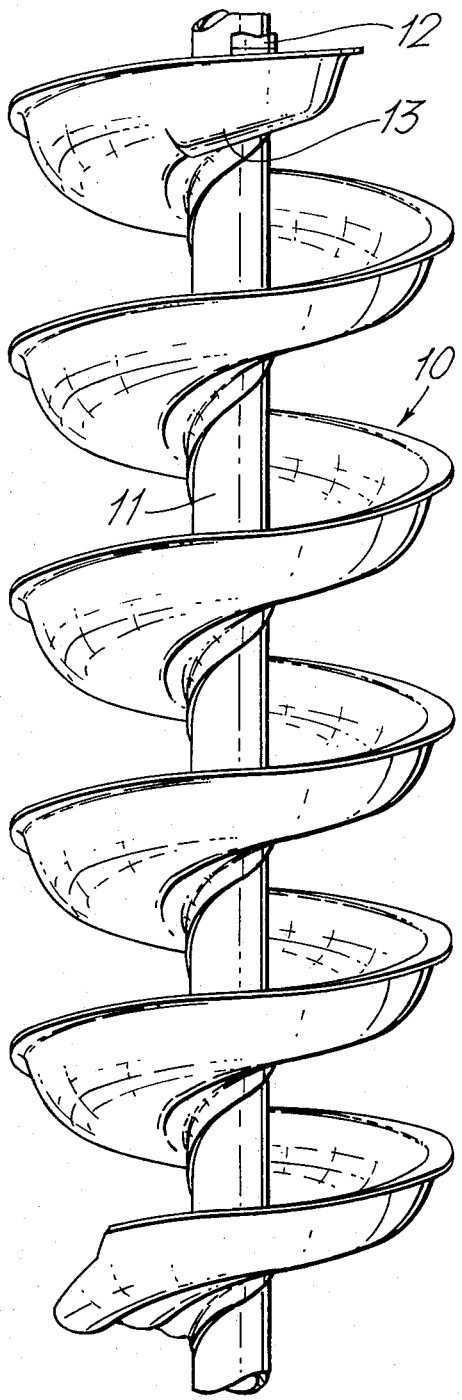
Fig. 1.
Fig. 5.
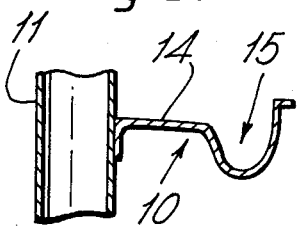
Fig. 6.
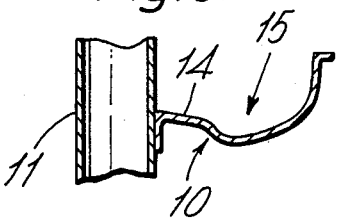
Fig. 7.
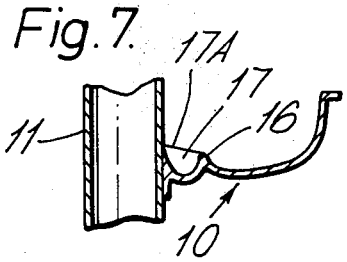
Fig. 8.
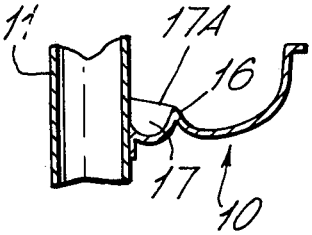

SPIRAL SEPARATOR

BACKGROUND OF THE INVENTION (1) Field of the Invention

This invention relates to a spiral separator.

(2) Description of the Prior Art

Spiral separators for wet separation of minerals are well known, such as a separator consisting of one or more helical sluices or "spirals" mounted on a central column, a pulp or slurry of water and the minerals to be separated being introduced to the head of each spiral, minerals of higher density or specific gravity tending to travel near to the inner part of the spiral, near to its axis, the less dense minerals travelling along the outer part of the spiral, so that the pulp forms strata, take-offs being provided for drawing off the required minerals, which may be separated into concentrates and tailings, or concentrates, middlings and tailings.

Some separation processes involve considerable difficulties, and conventional spiral separators and inadequate to achieve satisfactory results in such cases. This is notably the case when the minerals to be separated do not differ greatly in specific gravity, and/or when one of the minerals is of very low density. An example of this is the separation of asbestos from crushed rock.

BRIEF SUMMARY OF THE INVENTION

The present invention has been devised with the general object of providing a spiral separator which is particularly efficient in such applications.

It has been found from experiments that, in such a separation process, difficulties commence with the presentation of the pulp to the spiral.

The invention provides a spiral separator including an upright column and supported with its axis substantially vertical which is adapted to receive at an upper end thereof a pulp of water and particles to be separated, said spiral separator also including a plurality of helical turns mounted to said upright column wherein at least in a top portion of the separator there is provided a channel located on an outer part of the separator which is initially narrow and deep and becomes progressively wider to enable the particles to obtain or maintain an initial velocity so as to maintain the flow of pulp without the coarser and/or less dense particles becoming stationary or stranding and wherein the coarser and/or less dense particles may be retained in an outer section of the channel and the finer and/or denser particles may move toward an inner section of the channel and be retained in said inner section.

Preferably the channel also has a base wall or floor which inclines slightly downwardly towards the upright column. Suitably this angle may become less steep throughout at least part of the length of the channel.

The channel also becomes progressively wider and may have an inner wall which converges towards the axis of the spiral separator at least initially. The inner wall may also decrease in height with respect to the outer wall which suitably is of fixed or uniform height.

The inner wall in an intermediate part of the separator may suddenly increase in height thereby forming a partition between an inner trough and the channel. Alternatively the inner wall of the channel may merge with an adjacent portion of the separator from a ledge which may extend slightly downwardly and outwardly from the upright column.

The initial part of the channel which has a width which progressively increases from being deep and narrow to relatively shallow may occur substantially within the first half a turn of the separator. The width may suitably thereafter progressively increase to the end of the second turn whereafter it may have a relatively constant width.

Preferably an upper portion (e.g. the first turn) of the separator is of small pitch, increasing to a considerably greater pitch in a lower portion such as the second turn thereof, and thereafter diminishing with subsequent turns.

Preferably after several turns, when the pulp has stratified, the above mentioned partition is developed extending up from the sluice bottom to separate the inner from the outer strata, this partition having gaps or openings at about each turn enabling the passage of denser minerals skirting the outside of the partition to the inner trough within the partition. The above mentioned ledge may also include the gaps or openings. Preferably the final part of the last turn of the separator is decreased in radius and increased in pitch to increase velocity of the pulp, and this part of the separator is divided by splitter walls to separate concentrates, middlings and tailings. Other features of the invention will become apparent from the following description.

As used in the specification, the term "pitch" refers to the vertical distance between adjacent turns of the separator at corresponding locations.

BRIEF DESCRIPTION OF SEVERAL VIEW OF THE DRAWINGS

One embodiment of the invention is shown, by way of illustrative example only, in the accompanying drawings, wherein:

FIG. 1 is a side elevation of a single-start spiral separator according to the invention;

FIG. 5 is a sectional view along line 5—5 in FIG. 2;

FIG. 6 is a sectional view along line 6—6 in FIG. 2;

FIG. 7 is a sectional view along line 7—7 in FIG. 3; and,

FIG. 8 is a sectional view along line 8—8 in FIG. 4.

DETAILED DESCRIPTION OF THE PREFERRED EMBODIMENTS

The spiral separator illustrated includes a single spiral 10 mounted about an upright tubular column 11. Ordinarily the separator would be of "two-start" type, with two identical spirals 10 mounted about the column 11, their heads and discharge ends being angularly spaced apart, but for clarity of illustration the single spiral only is shown.

Figure 2:
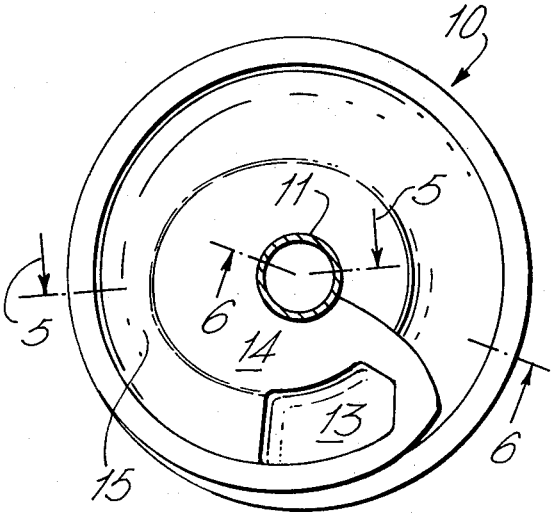
FIG. 2 is a plan view of the separator.

At the head of the separator pulp is discharged through a feed pipe 12 into a recess or downward extension 13 in the separator bottom the pulp in the bottom of this recess minimising frictional wear of the separator bottom at this position. As shown in FIG. 2, the radius of the separator at its head is reduced, thus enabling the installation of two separators on the central column 11 without fouling.

The first turn of the separator is formed with a high and wide boss 14 about the column, as shown in FIGS. 2 and 5, constricting the flow of pulp into a narrow and deep channel or trough 15 having an inner wall and outer wall as shown. Within the first turn of the separator, this boss gradually decreases in width and height to become indistinguishable from the inner wall, so that the channel or trough 15 is progressively widened and decreased in depth, as shown in FIGS. 2 and 6. The first turn of the separator, as shown in FIG. 1, is of small pitch, say about 24 cm. (the maximum inside radius of the separator being 29 cm.); but the pitch of the second turn is increased gradually to about 35 cm. It is found that the rapid flow of the pulp into the deep and narrow channel 15 ensures that the coarser and/or less dense particles such as asbestos or coal, is maintained in suspension without any tendency to stranding of the particles, and the gradual or progressive widening of the channel 15 and decreasing of its depth, facilitates the finer and/or denser particles moving toward the inner part of channel 15 after being initially evenly dispersed throughout the pulp. At the same time the coarser and/or less dense particles may be retained in the outer part of channel 15.

Figure 3:
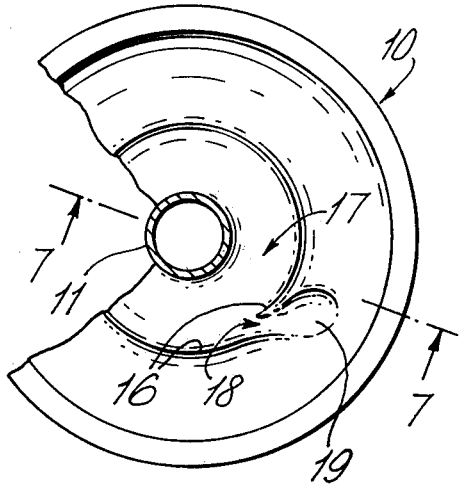
FIG. 3 is a plan view of part of an intermediate turn of the separator.
Figure 4:
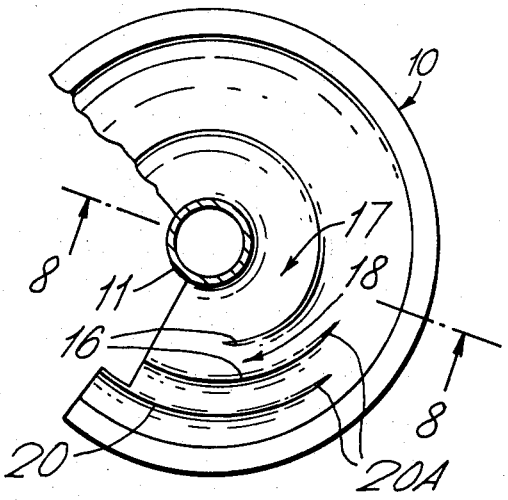
FIG. 4 is a plan view of part of an intermediate turn of the separator.

In the third turn of the separator, the pitch is somewhat decreased, say to about 32 cm. and the inner wall of the channel 15 may be increased in height to form a gradually rising partition 16 spaced from the inside of the separator to form an inner trough 17 dividing the denser or finer materials from the coarser or less dense. This wall continues down the separator, gradually increasing in depth and, at about the end of each turn, as shown in FIGS. 3 and 4, it is formed with a break or gap 18, the up-stream wall end curving in, the downstream wall end turning out, so that denser or finer minerals travelling close to the outside of the wall 16 will be guided into the inner trough 17. This is facilitated by a lead-in depression 19 in the separator bottom up-stream of the gap 18 and outside the wall 16. However depression 19 may be omitted in some cases particularly if a shelf 17A is used to replace trough 17 as hereinafter explained.

In some cases, trough or groove 17 may be dispensed with and replaced by a shelf 17A shown in dotted outline in FIGS. 7 and 8. Shelf 17A may be utilised for the application of wash water to further separate the desired minerals from the pulp.

The fourth turn and most of the fifth turn of the separator may be of about 30 cm. pitch; but the final part of the fifth or final turn is increased in pitch and decreased in radius to increase the velocity of the final run of the pulp. In this final part of the separator, a further dividing wall 20 is developed so that the pulp leaving the sluice is divided into denser or finer particles from the innermost trough 17, middlings passing between the walls 16 and 20, and coarser or less dense fractions from the outermost part of the spiral.

If required, adjustable splitters (not shown) may be placed at locations 20A shown in FIG. 4.

In the case of the separation of asbestos from crushed rock, the asbestos is recovered mainly from the outermost part of the spiral, the denser rock particles from the inner trough 17 being the tailings. The middlings may be re-processed for further separation.

Spiral separators according to the invention will be found to be very efficient in operation, and therefore enabling the effective wet-separation of asbestos which, because of its carcinogenic nature may present serious health dangers if processed dry, the pulp with high water content effectively preventing any likelihood of danger from air-borne asbestos particles.

The invention, as well as being useful in the separation of asbestos from crushed rock will, in fact, be found to be extremely useful in the classification of low density particles generally and in particular in the washing of fine coal particles from coal ash. It also may be used in the classification of low grade tin ore wherein the low grade particles of debris (sometimes called gangue) will move to the outer part of the channel unlike the other two examples referred to above wherein the debris will move to the inner part of the channel.

What is claimed is:

1. A spiral separator comprising an upright column and supportable with its axis substantially vertical which is adapted to receive at an upper end thereof a pulp of water and particles to be separated, said spiral separator further comprising a continuous helical trough mounted to said upright column wherein at least in a top portion of the trough there is provided a channel which is initially narrow and deep and becomes progressively wider to enable the particles to obtain or maintain an initial velocity so as to maintain the flow of pulp without the coarser and/or less dense particles becoming stationary or stranding and wherein the coarser and/or less dense particles may be retained in an outer section of the trough and the finer and/or denser particles may move toward an inner section of the trough and be retained in said inner section.

2. A spiral separator as claimed in claim 1 wherein the channel has an outer wall which is substantially uniform in height and an inner wall which progressively converges towards the axis of the separator and which also progressively decreases in height relative to said outer wall.

3. A spiral separator as claimed in claim 1 or 2 wherein the channel has a base wall or floor which inclines slightly downwardly relative to the axis of the separator.

4. A spiral separator as claimed in claim 3 wherein the base wall or floor becomes progressively less steep throughout at least part of the length of the channel.

5. A spiral separator as claimed in claim 2, wherein the inner wall of the channel in an intermediate part of the separator increases in height after progressively decreasing in height to form an inner trough separated from said channel by said inner wall.

6. A spiral separator as claimed in claim 2, wherein the inner wall of the channel merges with an adjacent portion of the separator to form an inner ledge intermediate the height thereof.

7. A spiral separator as claimed in claims 1, 2, 5 or 6 wherein the initial part of the separator which has the gradually increasing width extends for substantially a half a turn of the separator.

8. A spiral separator as claimed in claims 1, 2, 5 or 6 wherein initially the separator has an upper portion which is of relatively small pitch, thereafter increasing to form a lower portion of greater pitch, and thereafter forming a final position of lesser pitch.

9. A spiral separator as claimed in claim 8 wherein the lower portion of the separator is of substantially greater pitch than the upper portion and the final portion is of longer length than the upper and lower portions.

10. A spiral separator as claimed in claim 3 wherein the inner wall of the channel in an intermediate part of the separator increases in height after progressively decreasing in height to form an inner trough separated from said channel by said inner wall.

11. A spiral separator as claimed in claim 4 wherein the inner wall of the channel in an intermediate part of the separator increases in height after progressively decreasing in height to form an inner trough separated from said channel by said inner wall.

12. A spiral separator as claimed in claim 3 wherein the inner wall of the channel merges with an adjacent portion of the separator to form an inner ledge intermediate the height thereof.

13. A spiral separator as claimed in claim 4 wherein the inner wall of the channel merges with an adjacent portion of the separator to form an inner ledge intermediate the height thereof.

14. A spiral separator as claimed in claim 3 wherein the initial part of the separator which has the gradually increasing width extends for substantially a half a turn of the separator.

15. A spiral separator as claimed in claim 4 wherein the initial part of the separator which has the gradually increasing width extends for substantially a half a turn of the separator.

16. A spiral separator as claimed in claim 3 wherein initially the separator has an upper portion which is of relatively small pitch, thereafter increasing to form a lower portion of greater pitch, and thereafter forming a final portion of lesser pitch.

17. A spiral separator as claimed in claim 4 wherein initially the separator has an upper portion which is of relatively small pitch, thereafter increasing to form a lower portion of greater pitch, and thereafter forming a final portion of lesser pitch.

18. A spiral separator as claimed in claim 7 wherein initially the separator has an upper portion which is of relatively small pitch, thereafter increasing to form a lower portion of greater pitch, and thereafter forming a final portion of lesser pitch.

19. A spiral separator as claimed in claim 16 wherein the lower portion of the separator is of substantially greater pitch than the upper portion and the final portion is of longer length than the upper and lower portions.

20. A spiral separator as claimed in claim 17 wherein the lower portion of the separator is of substantially greater pitch than the upper portion and the final portion is of longer length than the upper and lower portions.

21. A spiral separator as claimed in claim 18 wherein the lower portion of the separator is of substantially greater pitch than the upper portion and the final portion is of longer length than the upper and lower portions.

* * * * *